United States Patent [19]

Fantoni

[11] 4,009,916

[45] Mar. 1, 1977

[54] CHIPCORE PANEL WITH ROUNDED AND BEVELLED EDGES OVERLAID WITH A SHEET OF PLASTIC MATERIAL

[75] Inventor: Marco Fantoni, Udine, Italy

[73] Assignee: McClure Furniture Industries, Inc., Milton, Pa.

[22] Filed: Aug. 28, 1974

[21] Appl. No.: 501,256

[30] Foreign Application Priority Data

Sept. 21, 1973 Italy ..... 83428/73

[52] U.S. Cl. ..... 312/204; 52/615; 428/76

[51] Int. Cl.[2] ..... A47B 17/04

[58] Field of Search ..... 52/758 H, 286, 615, 52/309; 403/401, 403; 161/43, 44, 41, 42; 312/204; 428/76, 68, 130

[56] References Cited

UNITED STATES PATENTS

| | | | |
|---|---|---|---|
| 3,141,206 | 7/1964 | Stephens | 52/615 |
| 3,192,099 | 6/1965 | Beckman et al. | 161/43 |
| 3,379,800 | 4/1968 | Wert | 161/43 |
| 3,397,496 | 8/1968 | Sohns | 52/286 |
| 3,415,708 | 12/1968 | Rondum | 428/76 |
| 3,435,582 | 4/1969 | Disney et al. | 161/43 |
| 3,763,029 | 10/1973 | Karn | 52/309 |

*Primary Examiner*—Werner H. Schroeder
*Assistant Examiner*—Doris L. Troutman

[57] ABSTRACT

A chipcore furniture panel with rounded and bevelled edges overlaid with a sheet of plastic material. The edges of the panel are bevelled along the whole thickness of the panel with even width and inclination of the bevels on all perimetrical sides; and the edges are connected to the sides along the longer outside perimeter with a curve of determined radius. In addition, one overlay sheet is so applied as to eliminate the seam along the curved intersection of the bevelled sides and corresponding panel face.

4 Claims, 3 Drawing Figures

FIG. 1
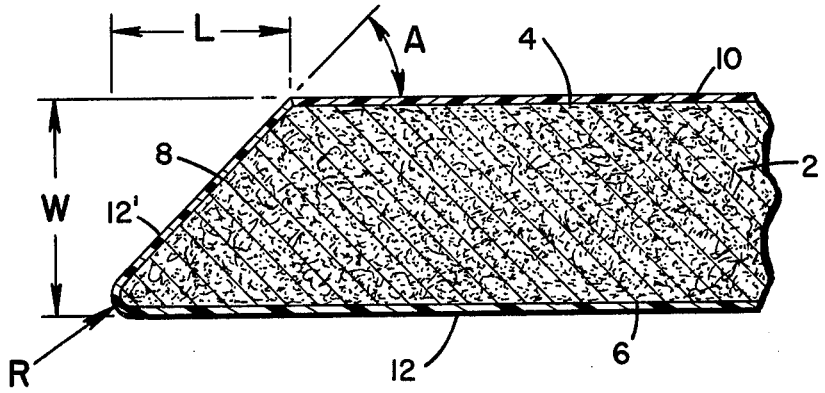
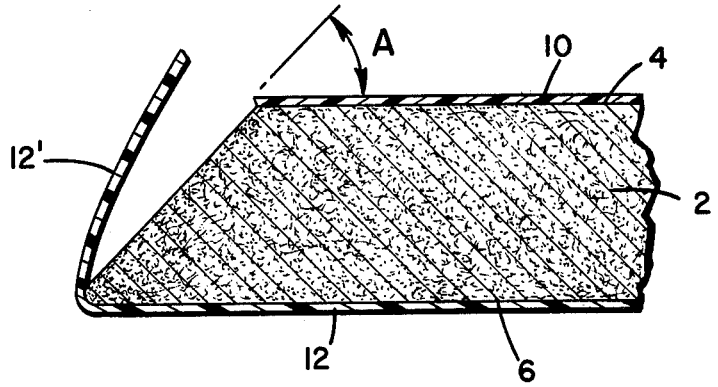
FIG. 2
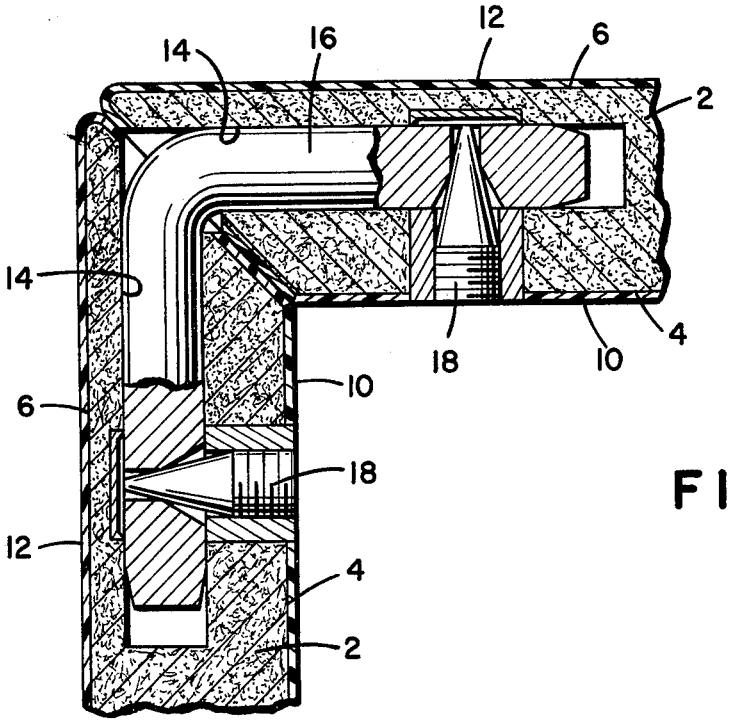
FIG. 3

CHIPCORE PANEL WITH ROUNDED AND BEVELLED EDGES OVERLAID WITH A SHEET OF PLASTIC MATERIAL

BACKGROUND OF THE INVENTION

The present invention is directed to chipcore furniture panels having rounded and bevelled edges and an overlay of plastic sheet material.

The present invention is an improvement upon the usual overlaid furniture panels. Generally speaking, most known furniture panels are generally rectangular in shape; this causes assembly problems when applying overlays to the panels due to problems incurred in adhering the overlays to the panels along their edges where the seams of the overlays have to be positioned. Because of the 90° edges of the panels, very often the seams will become unglued with a minimum of wear.

The object of the present invention, therefore, is to create an overlaid modular panel which overcomes the aforementioned difficulties associated with prior art furniture panels of this type. Basically this invention consists of a chipcore panel of trapezoidal shape with rounded edges in its orthogonal sections. It therefore differs from the usual parallelepiped panel because its perimetrical sides are bevelled along the whole thickness and because the corner resulting from such a bevelling is rounded off in a curve of determined radius. In addition, the overlaying of the panel can be carried out using only two sheets, which are bonded one to each face of the panel. The sheet bonded to the larger face of the panel will be cut larger than the dimensions of that face in order to allow folding over of the sheet for covering the rounded and bevelled edges.

Brief DESCRIPTION OF THE DRAWING

FIG. 1 is a cross-sectional view of the furniture panel with the covering layers applied;

FIG. 2 is a cross-sectional view of the furniture panel with one of the covering layers partially removed; and FIG. 3 is a sectional view of two furniture panels connected to each other.

DESCRIPTION OF THE PREFERRED EMBODIMENT

Referring to the drawing figures, a furniture panel 2, such as a chipcore panel, has first and second major surfaces 4 and 6, respectively, which comprise the top and bottom surfaces of the panel; in two contemplated examples, the width W of the panel may be on the order of 22 or 35 millimeters.

A feature of the panel of this invention is that the edge surfaces 8 are all bevelled uniformly around the perimeter of the panel. Preferrably, the bevelled edge 8 forms an angle A of about 45° with the parallel major surfaces 4 and 6. The intersection of edge 8 and surface 6 is made on a curve having a radius R of approximately 2.5 millimeters preferrably, although a range of 1–5 millimeters is acceptable in practice. Also in the two contemplated examples, the amount of overhang L of surface 6 with respect to surface 4 is on the order of 18 and 25 millimeters, respectively.

The chipcore panel is covered with a layer of polyvinyl chloride or any similar semi-rigid sheet of plastic material which is resistant to abrasion and liquids; preferrably, the plastic sheet has a thickness of between 6 and 12 mils. The plastic sheet is applied in two parts. A first sheet 10 is applied to the surface 4 and cut to the same dimensions as surface 4, i.e. same length and same width. The sheet 10 is affixed to the surface 4 by any known water-based or epoxy adhesive with pressure. In practice, the sheet may be applied to the surface 4 and, after gluing, trimmed to match the dimensions of surface 4.

A second sheet of plastic material 12 is applied in a similar manner to surface 6 except that sheet 12 is not trimmed in the same manner as sheet 10. Rather, sheet 12 is made larger than the dimensions of surface 6 and the overhang portion 12' is wrapped around the curved portion of radius R and glued thereafter to the edge surface 8. Thus, the dimension in any one direction of the sheet 12 must be at least equal to the sum of the dimensions in the same direction of the major surface 6 and edge surface 8.

After the sheet 12 is glued to the surface 6 in the same manner as sheet 10, pressure is applied to the portion 12' to wrap it around the curve of radius R; portion 12' is then affixed to edge surface 8 with a heat-melt adhesive while applying pressure to the layer 12'. Finally, portion 12' is trimmed to meet the adjacent edge of panel 10 with a close a fit as possible.

By this construction, the seam along what is ordinarily the most visible edge (edge R) is eliminated, the only remaining seams being those between edges 4 and 8 and between adjacent edges 8 where they meet at the corners of the panel. These edges have substantially smaller angles than the edge between surfaces 6 and 8; this results in better and longer lasting adhesion of the plastic overlays as well as improved aesthetic appearance, since the seams are less visible.

The furniture panels may be connected to each other in any of several ways, one such being shown in FIG. 3. In this example, intended for constructing desks and the like, a hole 14 is drilled into the panel from edge surface 8. A right angle bar 16 is inserted into the holes 14 and secured in each panel (on comprising the desk top and the other a side panel/leg) by a set screw arrangement 18. This provides a strong and stable connection which will not wobble or shake.

It is to be understood that various modifications in the structural details of the preferred embodiment described herein may be made within the scope of this invention and without departing from the spirit thereof. It is intended that the scope of this invention shall be limited solely by the hereafter appended claims.

What is claimed is:

1. In an article of furniture composed of a plurality of panels, each of said panels comprising: first and second opposite major parallel surfaces; edge surfaces connecting said first and second major parallel surfaces and bevelled outwardly from said first to said second surface; a first layer of plastic sheet material fixed to said first major surface and trimmed to substantially the same dimensions as said first surface; and a second layer of plastic sheet material fixed to said second major surface and extending over and fixed to said bevelled edge surfaces; said second layer having substantially the same dimensions as the combined dimensions of said second major surface and said bevelled edge surfaces, said first and second layers being trimmed to meet at the intersection of said bevelled edge surfaces and said first major surface; wherein the bevelled edge surface of one of said panels lies adjacent a complementary bevelled edge surface of another of said panels such that the second major surfaces of the two panels face outwardly of said furniture article and the exposed edges of said panels are covered by said second layers of sheet material.

2. The furniture panel according to claim 1, wherein said second layer extends from said second major surface to said bevelled edge surface about a curve having a radius in the range of from 1 to 5 millimeters approximately.

3. The furniture panel according to claim 2, wherein said radius of curvature is approximately 2½ millimeters.

4. The furniture panel according to claim 2, wherein said bevelled edge surfaces form angles of approximately 45° with each of said first and second major surfaces.

* * * * *